US007337756B1

(12) United States Patent
Ruble et al.

(10) Patent No.: US 7,337,756 B1
(45) Date of Patent: Mar. 4, 2008

(54) CYLINDER LINER FOR INTERNAL COMBUSTION ENGINE

(75) Inventors: Jan A. Ruble, Statham, GA (US); Navid Yavari, Alpharetta, GA (US)

(73) Assignee: PAI Industries, Inc., Suwanee, GA (US)

( * ) Notice: Subject to any disclaimer, the term of this patent is extended or adjusted under 35 U.S.C. 154(b) by 48 days.

(21) Appl. No.: 11/463,690

(22) Filed: Aug. 10, 2006

(51) Int. Cl.
*F02F 1/10* (2006.01)

(52) U.S. Cl. ..... 123/41.84; 29/888.061

(58) Field of Classification Search ..... 123/41.84, 123/41.81, 41.83, 41.74, 193.2, 193.1; 29/888.06, 29/888.061

See application file for complete search history.

(56) References Cited

U.S. PATENT DOCUMENTS 6,363,894 B1 4/2002 Barkman
6,722,320 B1 4/2004 Pham et al.
6,799,541 B1 * 10/2004 Clinton et al. ..... 123/41.84
7,146,939 B2 * 12/2006 Azevedo ..... 123/41.84

* cited by examiner

*Primary Examiner*—Stephen K. Cronin
*Assistant Examiner*—Hyder Ali
(74) *Attorney, Agent, or Firm*—Bryan W. Bockhop

(57) ABSTRACT

A coolant groove-type internal combustion engine has a cylinder block that includes a frame having at least one longitudinal surface and a lateral member transverse to the longitudinal surface, the lateral member defining a coolant passage therethrough, wherein the lateral member also defines at least one cylinder opening and a groove coolant port extending from the coolant passage to the cylinder opening. A cylinder liner includes a cylindrical member, defining an elongated cylinder bore. The cylinder member has an outer surface that has a diameter that allows the cylindrical member to be fitted into the cylinder opening so as to form a coolant jacket between the outer surface of the cylindrical member and the longitudinal surface. The outer surface of the cylindrical member includes an upper portion that plugs the groove coolant port.

6 Claims, 2 Drawing Sheets

CYLINDER LINER FOR INTERNAL COMBUSTION ENGINE

BACKGROUND OF THE INVENTION

1. Field of the Invention

The present invention relates to internal combustion engines and, more specifically, to a cylinder liner for a coolant groove-type internal combustion engine.

2. Description of the Prior Art

Internal combustion engines, such as diesel and gasoline engines, are heat engines in which the burning of a fuel occurs in a confined space to create gases of high temperature and pressure. The gasses are permitted to expand in the engine to do work. Typically, an internal combustion engine includes a cylinder into which fits a piston. The fuel is burned in the space formed by the cylinder and the piston, driving the piston outwardly when the burning gasses expand. The piston is usually coupled to a connecting rod that transfers the reciprocating lateral motion of the piston to a crank shaft. The crankshaft translates the lateral motion to rotary motion, which is ultimately applied to perform useful work.

Modern truck engines tend to have more horsepower than earlier designs. This increased horsepower results in higher a heat output and a corresponding need for greater cooling capacity. To facilitate cooling of the pistons and cylinders, one prior art system, a coolant groove-type internal combustion engine as shown in FIGS. 1A-1C, includes a cylinder block frame 14 having a longitudinal 16 surface and a lateral member 18 transverse to the longitudinal surface 16. The lateral member 18 defines a coolant passage 20 therethrough and also defines at least one cylinder opening 22. A groove coolant port 28 extends from the coolant passage 20 to the cylinder opening 22. A coolant return 40 is spaced apart from the groove coolant port 28.

A cylinder liner 10 fits into the cylinder opening 22 and defines an elongated cylinder bore 32, into which fits a piston 24. The cylinder liner 10 has an outer surface 30, which forms a coolant jacket 38 (also referred to as a "water jacket") between the outer surface 30 of the cylinder liner 10 and the longitudinal surface 16. The outer surface 30 of the cylinder liner 10 includes a coolant groove 34 that is aligned with the groove coolant port 28.

Coolant is allowed to flow around the coolant groove 34 between the groove coolant port 28 and the coolant return 40, thereby facilitating cooling of the piston liner 10. However, in current designs, the groove coolant port 28 and the coolant return 40 both feed into the coolant jacket 38 without a pressure differential between the groove coolant port 28 and the coolant return 40. Thus, the coolant flow rate through the coolant groove 34 cannot be assured. When the coolant flow rate drops below a critical point, the coolant can boil and form steam in the coolant groove 34. Since steam acts as an insulator, steam formation can result insufficient cooling, especially in the upper portions of the cylinder liner. It can also result in excessive pressure in the cooling system. Both of these phenomena can lead to degraded engine performance and reduced lifetime.

Therefore, there is a need for cylinder liner that may be fitted into a coolant groove-type internal combustion engine that prevents steam formation in the upper portions of the cylinder liner.

SUMMARY OF THE INVENTION

The disadvantages of the prior art are overcome by the present invention which, in one aspect, is a cylinder liner for a coolant groove-type internal combustion engine, having a cylinder block that includes a frame having at least one longitudinal surface and a lateral member transverse to the longitudinal surface, the lateral member defining a coolant passage therethrough, wherein the lateral member also defines at least one cylinder opening and a groove coolant port extending from the coolant passage to the cylinder opening. The cylinder liner includes a cylindrical member, defining an elongated cylinder bore. The cylinder member has an outer surface that has a diameter that allows the cylindrical member to be fitted into the cylinder opening so as to form a coolant jacket between the outer surface of the cylindrical member and the longitudinal surface. The outer surface of the cylindrical member includes an upper portion that plugs the groove coolant port.

In another aspect, the invention is an internal combustion engine that includes a cylinder block and a replacement cylinder liner. The cylinder block includes a frame having at least one longitudinal surface and a lateral member transverse to the longitudinal surface. The lateral member defines a coolant passage therethrough and also defines at least one cylinder opening and a groove coolant port extending from the coolant passage to the cylinder opening. The replacement cylinder liner is retrofitted into the cylinder opening and includes a cylindrical member having an outer surface that has a diameter that allows the cylindrical member to be fitted into the cylinder opening so as to form a coolant jacket between the cylindrical member and the longitudinal surface. The outer surface of the cylindrical member includes an upper portion that plugs the groove coolant port.

In another aspect, the invention is a method of retrofitting a cylinder liner into a coolant groove-type internal combustion engine that includes a cylinder opening and groove coolant port opening thereto. An existing cylinder liner is removed from the engine, thereby exposing the cylinder opening and the groove coolant port. The groove coolant port is plugged by placing a replacement cylinder liner, that includes an outer surface of a cylindrical member including an upper portion that plugs the groove coolant port, into the engine.

In yet another aspect, the invention is a method of making a replacement cylinder liner for use in a coolant groove-type internal combustion engine having at least one cylinder opening with a groove coolant port opening thereto. A piece of stock is machined to form a cylindrical shape that is complimentary in shape to the cylinder opening. The cylindrical shape is machined to include an outer surface having an upper portion configured to plug the groove coolant port when the cylindrical shape is placed in the cylinder opening. A cylindrical passage is bored through the cylindrical shape such that the cylindrical shape is complimentary in diameter to a piston, thereby forming the replacement cylinder liner.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1A:
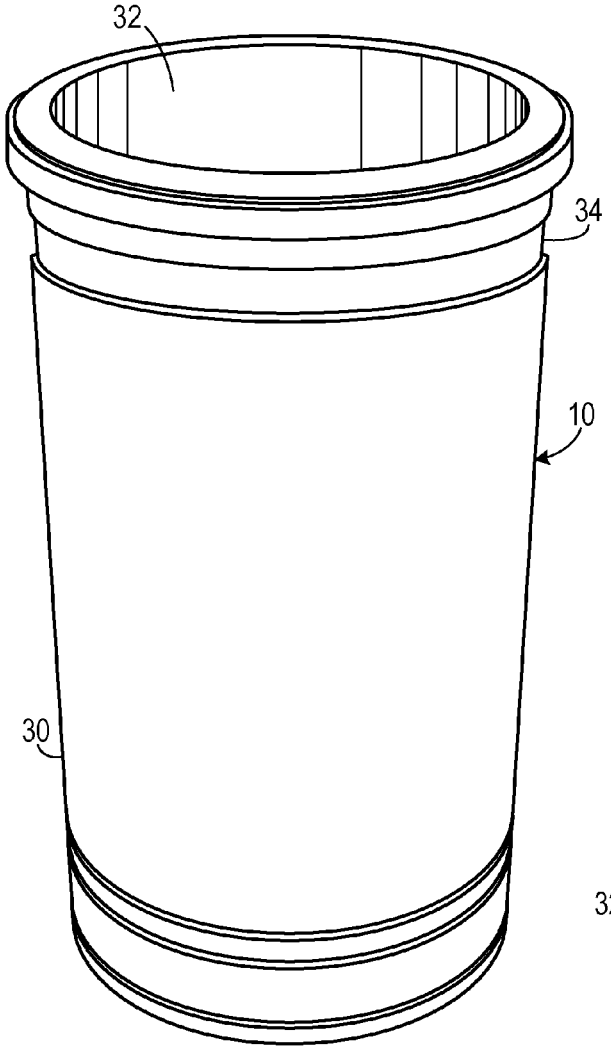
PRIOR ART FIG. 1A
FIG. 1A is a top perspective view of a prior art cylinder liner.
Figure 1C:
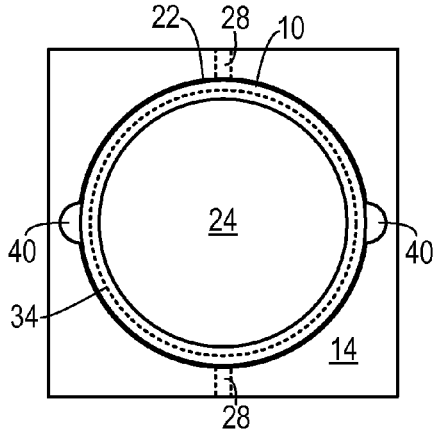
PRIOR ART FIG. 1C
FIG. 1C is a plan view of a portion of a prior art engine block employing a prior art cylinder liner.
Figure 1B:
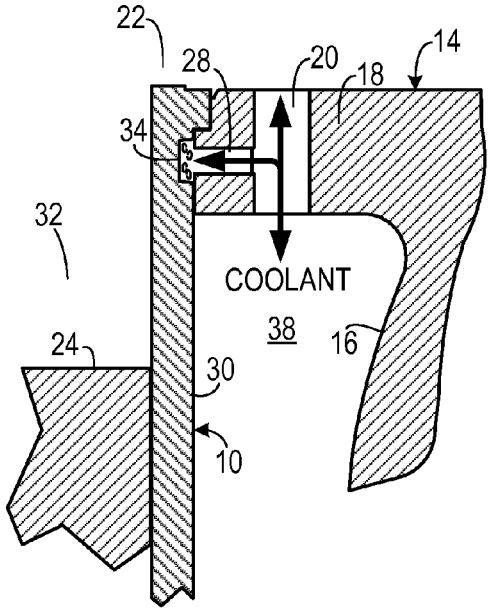
PRIOR ART FIG. 1B
FIG. 1B is a cross-sectional view of a portion of a prior art engine block employing a prior art cylinder liner.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on."

Figure 2A:
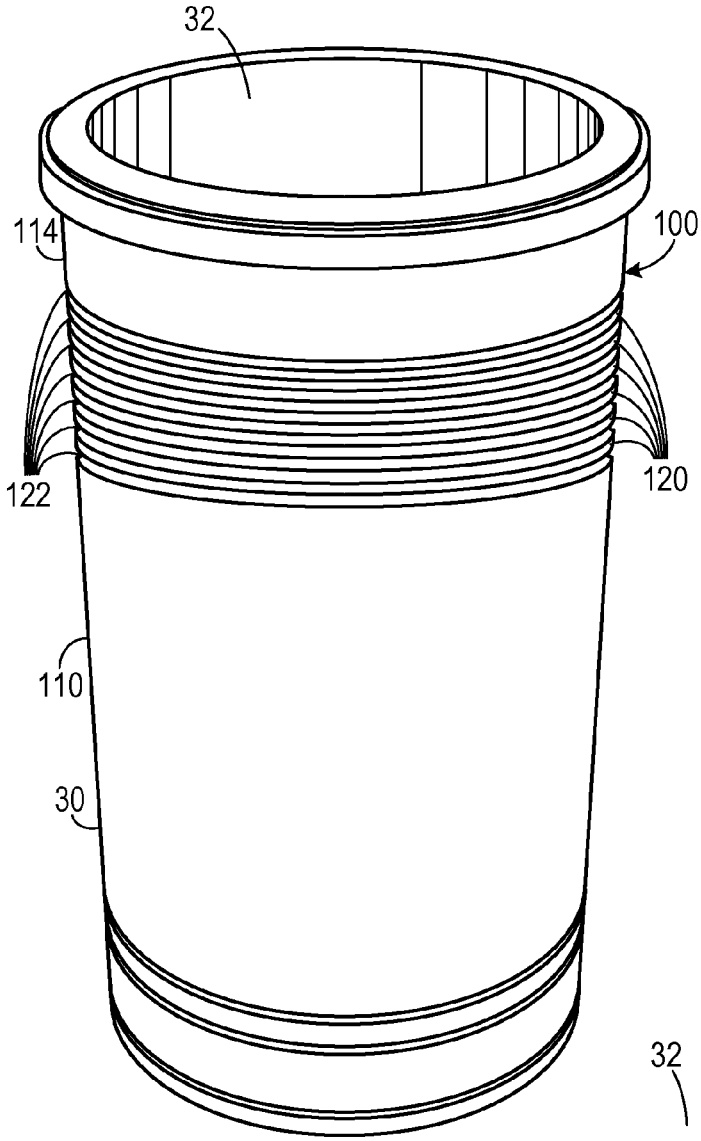
FIG. 2A is a top perspective view of a cylinder liner according to one representative embodiment of the invention.
Figure 2B:
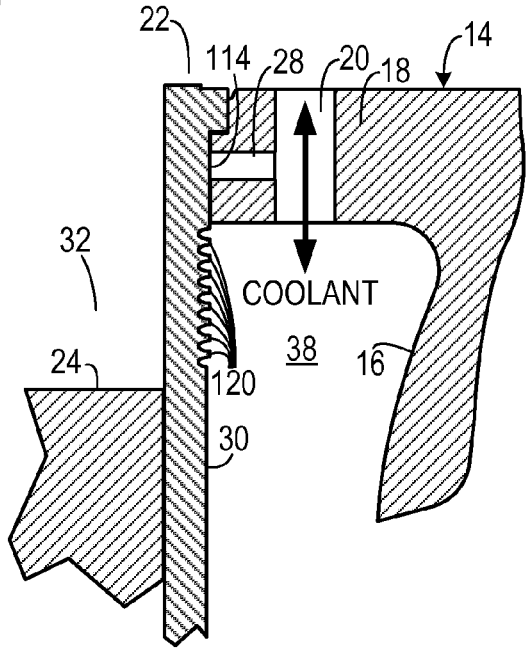
FIG. 2B is a cross-sectional view of a portion of an engine block employing a cylinder liner according to one representative embodiment of the invention.

As shown in FIGS. 2A and 2B, one embodiment of the invention is a cylinder liner 100 for a coolant groove-type internal combustion engine. The engine includes a cylinder block that includes a frame 14 having at least one longitudinal 16 surface and a lateral member 18 transverse to the longitudinal surface 16. The lateral member 18 defines a coolant passage 20 therethrough. The lateral member also defines at least one cylinder opening 22 and a groove coolant port 28 extending from the coolant passage 20 to the cylinder opening 22.

The cylinder liner 100 includes a cylindrical member 110 that defines an elongated cylinder bore 32. The cylinder member 110 has an outer surface 30 that has a diameter that allows the cylindrical member 110 to be fitted into the cylinder opening 22 so as to form a coolant jacket 38 between the outer surface 30 of the cylindrical member 110 and the longitudinal surface 16. The outer surface 30 of the cylindrical member 110 includes an upper portion 114 that plugs the groove coolant port 28.

A plurality of cooling fins 120 is also disposed on the outer surface 30 of the cylinder liner 100. The cooling fins are disposed so as to be in contact with the coolant in the coolant jacket 38. In one embodiment, the cooling fins 120 are disposed circumferentially about the outer surface. In one embodiment, the outer surface 30 of the cylinder liner defines a plurality of spaced apart circumferential grooves 122. The raised space between each groove 122 defines the cooling fins 120.

In one embodiment, the cylinder is made as a replacement cylinder that is retrofitted into a coolant groove-type internal combustion engine. When retrofitting a cylinder liner, an existing cylinder liner is removed from the engine, thereby exposing the cylinder opening 22 and the groove coolant port 28. The groove coolant port is then plugged by placing the replacement cylinder liner 100 into the engine. The cylinder liner may be made by machining a piece of stock to form a cylindrical shape that is complimentary in shape to the cylinder opening 22. Then a cylindrical piston bore 32 passage is bored through the cylindrical shape such that the cylindrical piston bore 32 is complimentary in diameter to the piston 32. The plurality of circumferentially disposed cooling fins 120 is then machined, e.g. with a metal lathe, into the outer surface of the cylinder liner by cutting circumferential grooves 122 into the outer surface 30 of the cylinder liner 100.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A cylinder liner for a coolant groove-type internal combustion engine, having a cylinder block that includes a frame having at least one longitudinal surface and a lateral member transverse to the longitudinal surface, the lateral member defining a coolant passage therethrough, wherein the lateral member also defines at least one cylinder opening and a groove coolant port extending from the coolant passage to the cylinder opening, the cylinder liner comprising:

a. a cylindrical member, defining an elongated cylinder bore, the cylinder member having an outer surface that has a diameter that allows the cylindrical member to be fitted into the cylinder opening so as to form a coolant jacket between the outer surface of the cylindrical member and the longitudinal surface, the outer surface of the cylindrical member including an upper portion that plugs the groove coolant port; and b. a plurality of cooling fins disposed on the outer surface of the cylinder liner in a portion of the outer surface that facilitates communication between the cooling fins and the coolant jacket.

2. The cylinder liner of claim 1, wherein the cooling fins are disposed circumferentially about the outer surface.

3. The cylinder liner of claim 1, wherein the outer surface of the cylinder liner defines a plurality of spaced apart circumferential grooves, a space between each groove defining a cooling fin.

4. An internal combustion engine, comprising:

a. a cylinder block that includes a frame having at least one longitudinal surface and a lateral member transverse to the longitudinal surface, the lateral member defining a coolant passage therethrough, the lateral member also defining at least one cylinder opening and a groove coolant port extending from the coolant passage to the cylinder opening;

b. a replacement cylinder liner retrofitted into the cylinder opening and including a cylindrical member having an outer surface that has a diameter that allows the cylindrical member to be fitted into the cylinder opening so as to form a coolant jacket between the cylindrical member and the longitudinal surface, the outer surface of the cylindrical member including an upper portion that plugs the groove coolant port; and c. a plurality of cooling fins disposed on the outer surface of the cylinder liner in a portion of the outer surface that facilitates communication between the cooling fins and the coolant jacket.

5. The cylinder liner of claim 4, wherein the outer surface of the cylinder liner defines a plurality of spaced apart circumferential grooves, a space between each groove defining a cooling fin.

6. A method of making a replacement cylinder liner for use in a coolant groove-type internal combustion engine having at least one cylinder opening with a groove coolant port opening thereto, comprising the actions of:

a. machining a piece of stock to form a cylindrical shape that is complimentary in shape to the cylinder opening such that the cylindrical shape includes an outer surface having an upper portion configured to plug the groove coolant port when the cylindrical shape is placed in the cylinder opening;

b. boring a cylindrical passage through the cylindrical shape such that the cylindrical shape is complimentary in diameter to a piston, thereby forming the replacement cylinder liner; and c. machining a plurality of circumferentially disposed cooling fins into the outer surface of the cylinder liner.

* * * * *